US007314052B2

(12) United States Patent
Yuhara et al.

(10) Patent No.: US 7,314,052 B2
(45) Date of Patent: Jan. 1, 2008

(54) VANITY CASE

(75) Inventors: Yukitomo Yuhara, Chiba (JP); Yuzo Yoshida, Tokyo (JP)

(73) Assignee: Yoshida Industry Co., Ltd., Tokyo (JP)

( * ) Notice: Subject to any disclaimer, the term of this patent is extended or adjusted under 35 U.S.C. 154(b) by 0 days.

(21) Appl. No.: 11/558,671

(22) Filed: Nov. 10, 2006

(65) Prior Publication Data

US 2007/0163919 A1 Jul. 19, 2007

(30) Foreign Application Priority Data

Jan. 18, 2006 (JP) ..... 2006-010501

(51) Int. Cl.
*A45D 33/24* (2006.01)
*B65D 71/00* (2006.01)

(52) U.S. Cl. ..... 132/294; 132/301; 206/581; 220/326

(58) Field of Classification Search ..... 206/235, 206/581, 823; 132/294, 301, 314, 315; 220/23.9, 220/323, 324, 326, 827, 829, 838
See application file for complete search history.

(56) References Cited

U.S. PATENT DOCUMENTS 4,799,604 A * 1/1989 Okojima et al. ..... 220/260
6,076,679 A * 6/2000 Yuhara et al. ..... 206/581
6,283,129 B1 * 9/2001 Yuhara et al. ..... 132/295

FOREIGN PATENT DOCUMENTS

JP 62-13531 8/1994

* cited by examiner

*Primary Examiner*—Luan K Bui
(74) *Attorney, Agent, or Firm*—Harness, Dickey & Pierce, PLC

(57) ABSTRACT

A vanity case which comprises a case body having a cavity, a lid coupled to the back section of the case body, and a tray frame received in the cavity of the case body so as to be slidable forwards and backwards. The lid has an engaging hook piece in the front of its underside. The tray frame has an engaging protrusion and the tray frame is always biased backwards. When the lid is closed, the engaging hook piece of the lid engages with the engaging protrusion of the tray frame. A rear end wall is integrally formed on the rear end of the tray frame in the middle so as to straddle a back wall of the case body, and when the rear end wall is pushed toward the front, the tray frame is moved forwards, thereby releasing the engagement between the engaging protrusion and the engaging hook piece.

4 Claims, 4 Drawing Sheets

VANITY CASE

CROSS-REFERENCE TO RELATED APPLICATIONS

The present application claims priority from Japanese Patent Application No. 2006-10501 filed on Jan. 18, 2006, which is herein incorporated by reference.

BACKGROUND OF THE INVENTION

1. Field of the Invention

The present invention relates to a vanity case for containing a cosmetic material that can improve appearance when its lid is closed against its case body and that can prevent the decrease in the strength of the case body with preventing the intrusion of dust into the case body.

2. Description of the Related Art

To date, a vanity case of which the lid is opened by operation at the rear of its case body has been known (refer to Japanese Examined Utility Model Application Publication No. S62-13531). This vanity case has a recess formed in the back end of its case body, and the hinge blocks of a lid are received in and coupled to the recess thus allowing the lid to be openable/closable against the case body. Further, a containing tray is arranged in the case body so as to be slidable backwards and forwards in the case body within a predetermined range, and the containing tray has a rear extension which protrudes into the recess of the case body through an opening made in the back wall of the case body without contacting the hinge blocks of the lid. A resilient member is interposed in between the containing tray and the case body to bias the containing tray so as to be returnable to a predetermined back position. A hook formed on the containing tray is opposite an engaging member protruding from the underside of the lid so as to detachably engage with it. An elastic member for biasing the lid toward opening is interposed in between the underside of the periphery of the lid and the top of the periphery of the case body. By pushing the rear extension of the containing tray forwards, the engagement between the hook of the containing tray and the engaging member of the lid is released, thus opening the lid by the elastic member.

In the above vanity case, because the opening is made through the back wall of the case body, there is the problem that the strength of the case body decreases. If the thickness of the back wall is made larger to compensate for the shortage of the strength, the case body will become larger in size or the containing capacity in the case body will be reduced. Moreover, the rear extension of the containing tray, which is pushed forwards when the lid is opened, protrudes into the recess of the case body, exposing itself to the outside. Hence, when the rear extension of the containing tray is pushed forwards, the back face of the case body is partly recessed between the hinge blocks of the lid. Accordingly, there is the problem that the appearance is not good for a vanity case. Further, because the opening is directly open to behind the case body, dust or the like is likely to intrude into the case body.

SUMMARY OF THE INVENTION

The present invention was made in view of the above problems of the prior art, and an object thereof is to provide a vanity case that can prevent the decrease in the strength of the case body and improve its appearance with preventing the intrusion of dust into the case body.

According to the present invention, there is provided a vanity case which comprises a case body having a cavity, a lid that is coupled to the back section of the case body in an openable/closable manner, and a tray frame that is received in the cavity of the case body so as to be slidable forwards and backwards. The lid has an engaging hook piece formed extending downwards on the front of its underside. The tray frame has an engaging portion that can engage with the engaging hook piece, and the tray frame is always biased elastically backwards. When the lid is closed against the case body, the engaging hook piece of the lid engages with the engaging portion of the tray frame and thus the lid is in a closed position. When the tray frame is moved forwards, the engagement between the engaging portion of the tray frame and the engaging hook piece of the lid is released, thus opening the lid. Further, the vanity case has such a structure that a rear end wall is integrally formed on the rear end of the tray frame in its middle so as to straddle a back wall of the case body to be movable forwards and backwards, and that when the rear end wall of the tray frame is pushed toward the front, the tray frame is moved forwards, thereby releasing the engagement between the engaging protrusion of the tray frame and the engaging hook piece of the lid.

Further, in the vanity case, a pair of hinge protrusions are formed protruding backwards on left and right ends of the back wall of the case body. Left and right hinge blocks protrude downwards from the rear end of the underside of the lid and are hinge-coupled to the pair of hinge protrusions, and in the state where the lid is closed against the case body, the rear faces of the hinge protrusions, the rear faces of the hinge blocks, and the rear end wall of the tray frame are substantially on the same vertical plane.

Yet further, in the vanity case, part of the back wall of the case body which the rear end wall of the tray frame straddles is lower in height and thicker than the rest of the back wall.

Still further, an elastic member may be provided in between the case body and the lid to always bias the lid toward opening.

Features and objects of the present invention other than the above will become apparent from the description of this specification and the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
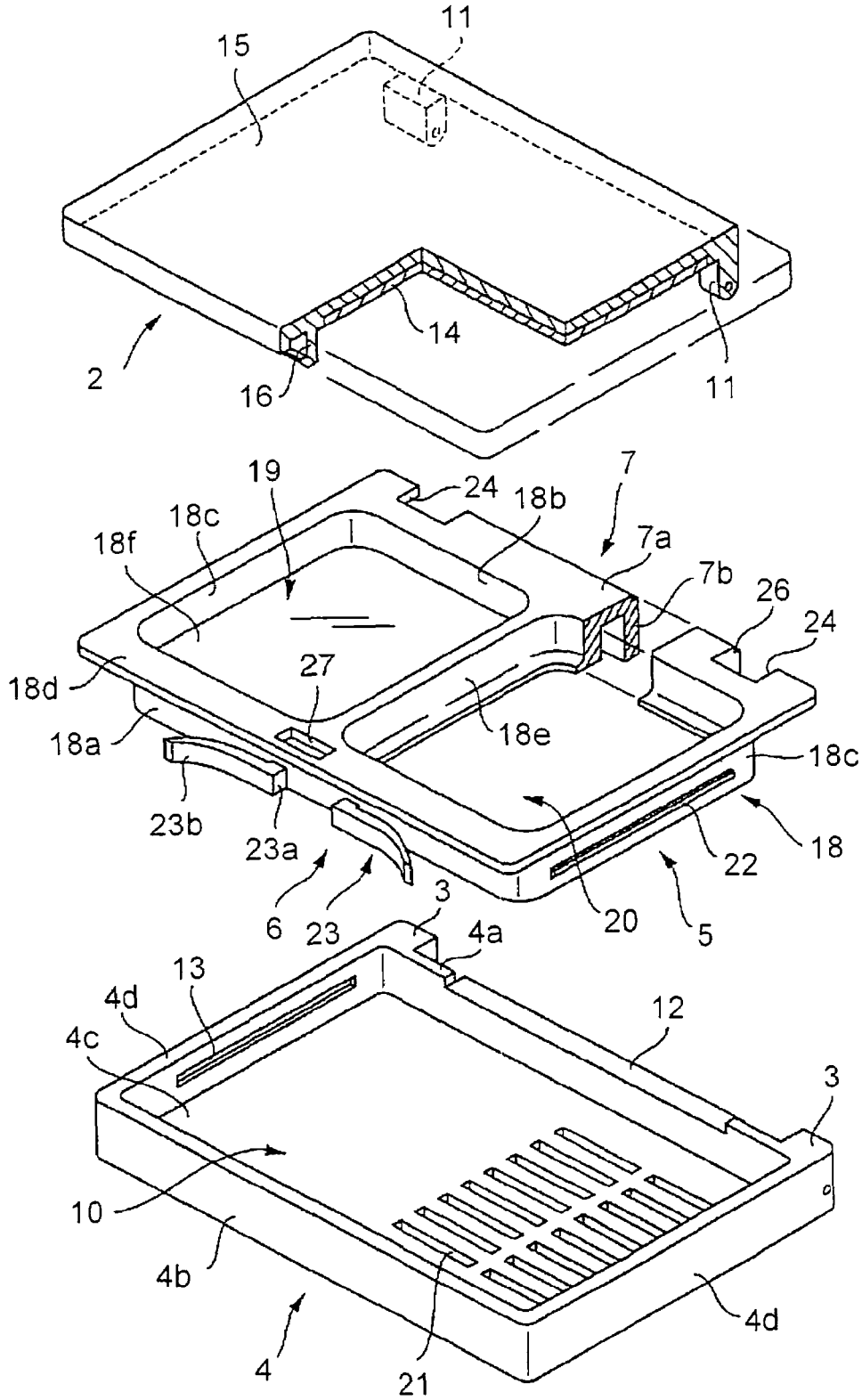
FIG. 1 is a partially-cutaway, exploded perspective view of a preferred embodiment of a vanity case according to the present invention.

At least the following matters will be made clear by the explanation in the present specification and the description of the accompanying drawings.

A preferred embodiment of a vanity case according to the present invention will be described below in detail with reference to the accompanying drawings. As shown in FIGS. 1 to 6, the vanity case 1 according to the present embodiment essentially comprises a case body 4, a tray frame 5 and a lid 2. The case body 4 contains therein the tray frame and the lid 2 is hinged to the case body.

The case body 4 is made up of a front wall 4*b* extending upwards from an outer edge of a bottom wall 4*c*, a back wall 4*a* opposite the front wall 4*b*, and a pair of left and right side walls 4*d* connecting the front wall 4*b* and the back wall 4*a*. A cavity 10 is formed in the case body 4, which is defined by the front wall 4*b*, the back wall 4*a*, and the side walls 4*d* and rectangular in plan view. The back wall 4*a* extends continuously in the left-to-right direction between the pair of left and right side walls 4*d*. The pair of hinge protrusions 3 protrude backwards from the left and right ends of the back wall 4*a*. Further, the back wall 4*a* has formed therein a rigid wall portion 12 extending continuously in the left-to-right direction so as to avoid hinge blocks 11 of the lid 2, described later, which portion 12 is lower in height and greatly thicker than portions adjacent to the hinge protrusions 3 to increase its rigidity. Slide grooves 13 are formed extending horizontally from near the front wall 4*b* toward the back wall 4*a* respectively in the inside of the pair of left and right side walls 4*d*.

The lid 2 mainly comprises a plate-like lid body 15 with a mirror 14 attached thereto, a pair of left and right hinge blocks 11 protruding down from the underside of the rear end of the lid body 15 at close to its left and right ends, and a hook piece 16 protruding down from the center of the lid body 15 front end at the underside. The lid 2 has the hinge blocks 11 rotatably coupled to the hinge protrusions 3 of the case body 4 by a hinge pin 17 so as to open and close the case body 4. The back faces of the hinge blocks 11 are substantially on the same vertical plane as those of the hinge protrusions 3 when the lid 2 is closed against the case body 4.

Figure 2:
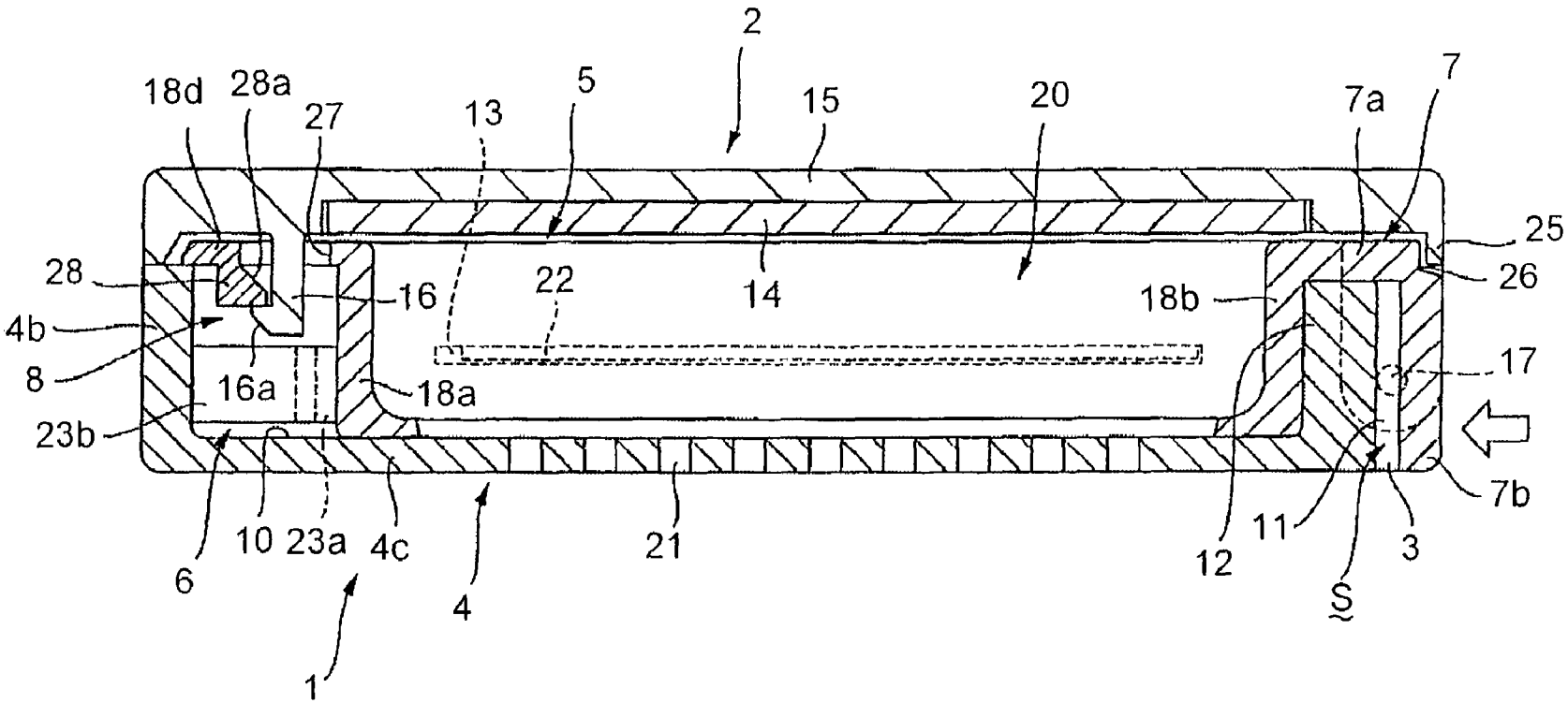
FIG. 2 is a side sectional view of the vanity case of FIG. 1.
Figure 3:
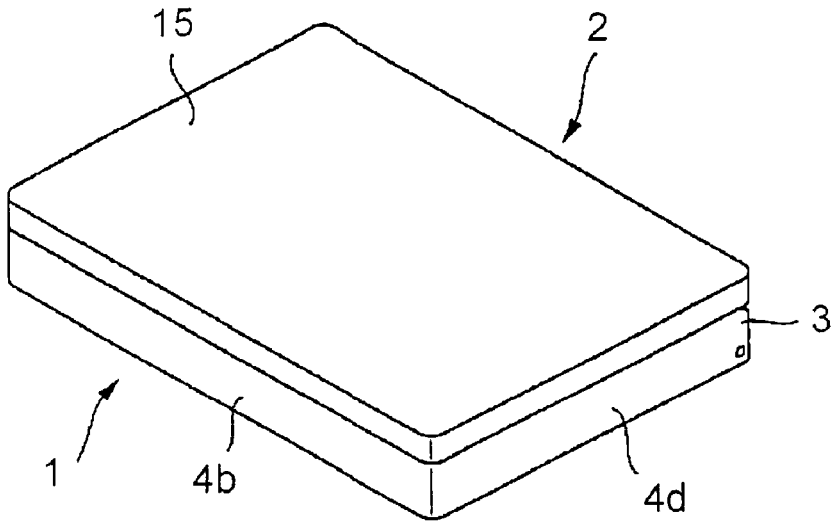
FIG. 3 is a perspective view of the vanity case of FIG. 1 as seen from above in front.
Figure 4:
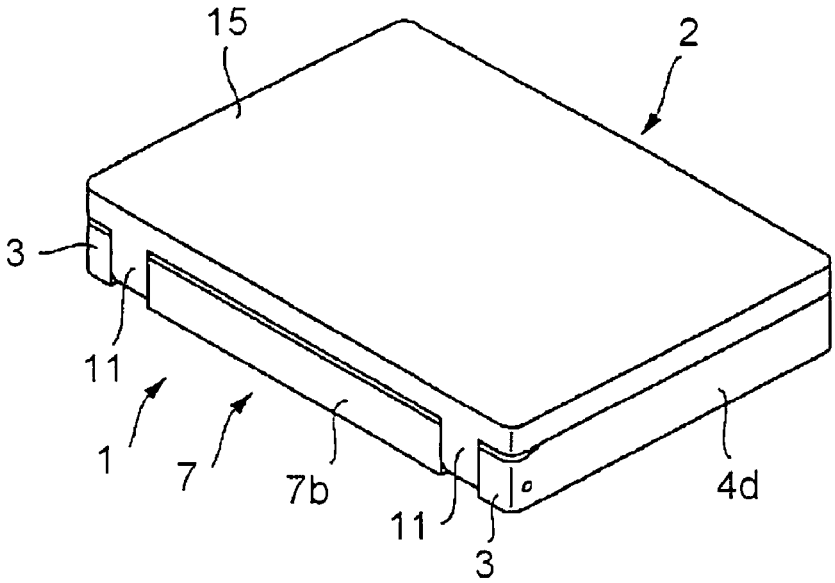
FIG. 4 is a perspective view of the vanity case of FIG. 1 as seen from above behind.
Figure 5:
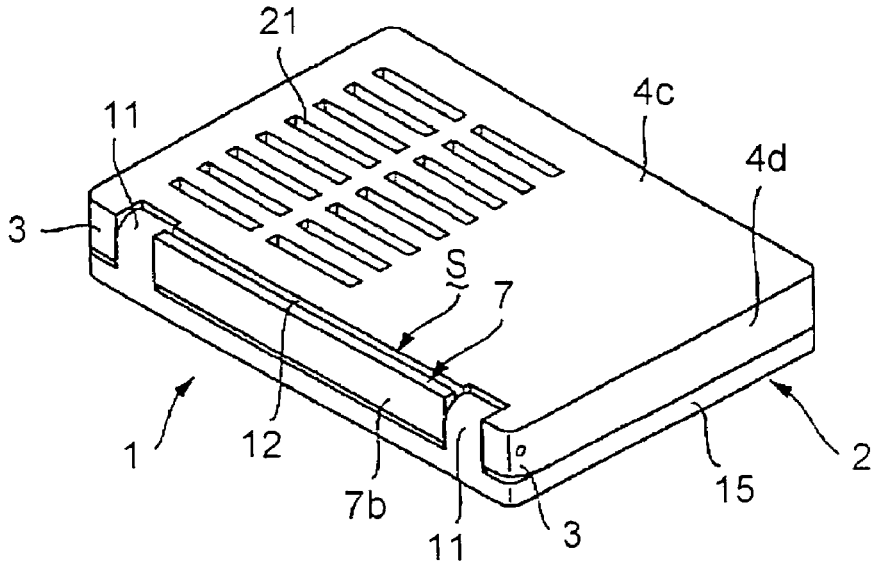
FIG. 5 is a perspective view of the vanity case of FIG. 1 as seen from below behind.

The tray frame 5 is mounted in the cavity 10 of the case body 4. The tray frame 5 is formed of an annular circumferential wall 18 made up of a front wall 18*a*, a back wall 18*b*, and a pair of left and right side walls 18*c* connecting the walls 18*a*, 18*b*; an annular canopy 18*d* extending outwards from the top of the circumferential wall 18 that is slidably placed on the front wall 4*b*, the back wall 4*a*, and the side walls 4*d* of the case body 4; and a partition wall 18*e* that divides the inside of the circumferential wall 18 into a pair of left and right containing portions 19, 20, and the outline thereof is rectangular in plan view. In the present embodiment, the right containing portion 20 is in communication with ventilation slits 21 made through the bottom wall 4*c* of the case body 4 as shown in FIG. 2, and a makeup tool such as a puff is contained therein. The left containing portion 19 has a bottom 18*f* and receives a cosmetic tray.

The annular circumferential wall 18 of the tray frame 5 is set slightly shorter in width in the left-to-right direction than the cavity 10 of the case body 4 and sufficiently shorter in length in the front-to-back direction than the cavity 10, that is, the size between the front wall 4*b* and the back wall 4*a*. Hence, the tray frame 5 is slidable forwards and backwards between the back wall 4*a* and the front wall 4*b*. A slide rib 22 is formed extending horizontally from near the front wall 4*b* toward the back wall 4*a* on each of the left and right side walls 18*c* of the tray frame 5 to guide the slide of the tray frame 5, and engages slidably with the slide groove 13.

A resilient member 6, which resiliently biases the tray frame 5 toward the back wall 4*a*, is disposed in the space between the front wall 18*a* of the tray frame 5 and the front wall 4*b* of the case body 4. In the present embodiment, the resilient member 6 is constituted by a pair of left and right resilient pieces 23 that are formed on the center of the front wall 18*a* and curved forwards. The resilient piece 23 has a base 23*a* of a larger diameter integrally joined to the tray frame 5, and a wing-shaped portion 23*b* extending from the end of the base 23*a* to the left or right, which portion is curved forwards and tapered at the end. By the end of the wing-shaped portion 23*b* contacting the front wall 4*b* of the case body 4, resilience relative to the front wall 4*b* occurs to bias the tray frame 5 backwards. Although in the present embodiment the resilient pieces 23 are integrally formed on the tray frame 5, they may be integrally formed on the case body 4 or separate from the tray frame 5 and the case body 4.

A pair of recesses 24 are formed in the annular canopy 18*d* of the tray frame 5 near the left and right ends of the back wall 18*b* so as to receive the hinge blocks 11 of the lid 2. A rear end wall 7, the pushing of which causes the tray frame 5 to slide toward the front wall 4*b*, is formed integrally with and behind the back wall 18*b* of the tray frame 5 to extend between the recesses 24. The rear end wall 7 is made of a horizontal wall 7*a* extending backwards from the top of the back wall 18*b* over the rigid wall portion 12 of the case body 4 and an upright wall 7*b* extending downwards from the end of the horizontal wall 7*a* to the level of the lower surface of the case body 4 bottom wall 4*c*, and is shaped like an L in sectional view. A space "S" is formed as shown in FIG. 2 between the upright wall 7*b* of the tray frame 5 and the rigid wall portion 12 of the back wall 4*a* of the case body 4 to secure the push stroke of the rear end wall 7 when the tray frame 5 is in a back position in the case body 4. Thus, the rear end wall 7 is formed so as to straddle the back wall 4*a* of the case body to be movable forwards and backwards.

The upright wall 7*b* of the rear end wall 7 is located between the recesses 24 and, when the lid 2 is attached, is sandwiched via the hinge blocks 11 of the lid 2 by the left and right hinge protrusions 3 of the case body 4, so that the entire rigid wall portion 12 is concealed from the outside. In the state where the tray frame 5 is biased backwards by the resilient member 6, the outer face of the upright wall 7*b* of the rear end wall 7 is substantially on the same vertical plane as those of the hinge protrusions 3 and the hinge blocks 11. Moreover, a recess 26 is made in the top corner of the rear end wall 7 to receive a lip 25 protruding down from the lid body 15 rear end of the lid 2.

A hook means 8 is provided between the lid 2 and the tray frame 5. A through hole 27 is made in the annular canopy 18*d* at a position corresponding to that of the hook piece 16 of the lid 2, and an engaging protrusion 28 is formed on the canopy 18*d* immediately under the through hole 27 so as to releasably engage with the hook piece 16 inserted through the through hole 27 to detachably attaching the lid 2 to the tray frame 5. Specifically, the engaging protrusion 28 protrudes backwards from the front edge of the through hole 27, and has a slope 28*a* formed on its top that slopes down backwards. A tab protrudes forwards from the lower end of the hook piece 16, and the underside of the tab forms a slope 16*a* that slopes down backwards.

While the hook piece 16 is being inserted through the through hole 27, the slope 16*a* underneath the hook piece 16 slides on the slope 28*a* of the engaging protrusion 28, at which time the tray frame 5 is slightly moved forwards with opposing the resilient force of the resilient member 6 and thereby the tab of the hook piece 16 slides over the engaging protrusion 28 and gets under it to put the hook 8 in an engaging state. The engagement of the hook 8 is released by pushing the upright wall 7*b* of the rear end wall 7 toward the front of the case body 4 to move the engaging protrusion 28 away from the hook piece 16.

Figure 6:
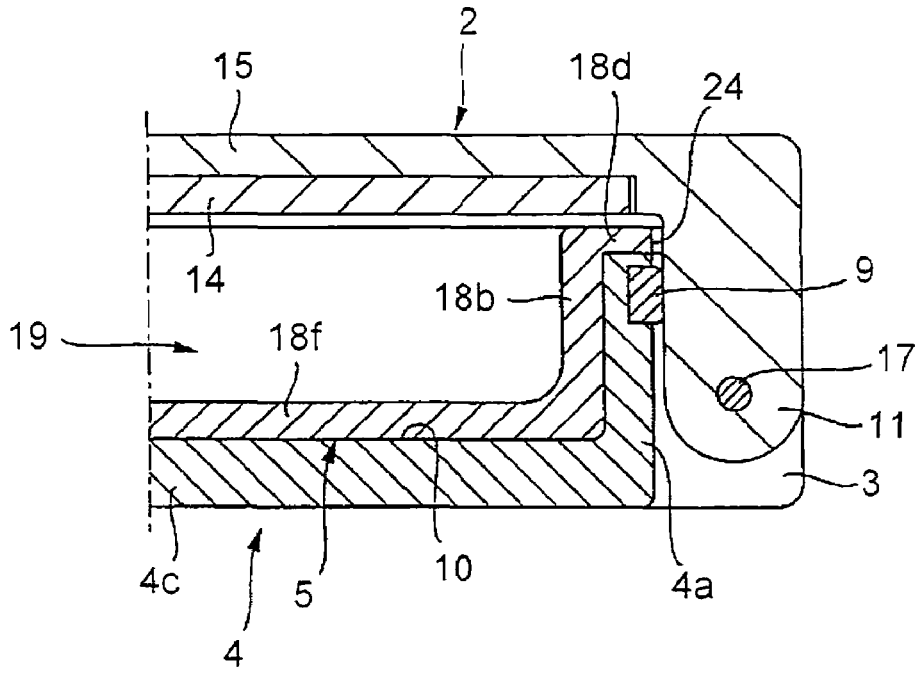
FIG. 6 is an enlarged side sectional view of a main part of the vanity case of FIG. 1.

Moreover, as shown in FIG. 6, there is provided an elastic body such as a rubber as a biasing member 9 in between the back wall 4*a* of the case body 4 and the hinge block 11 of the lid 2. The biasing member 9 is provided in the back wall 4*a* so as to protrude therefrom to the hinge block 11, and when the lid 2 is closed, elastically contacts the hinge block 11, thereby biasing the lid 2 toward opening via the hinge block 11.

The action of the vanity case 1 according to the present embodiment will be described. When assembling, with the rear end wall 7 of the tray frame 5 put on the rigid wall portion 12 of the case body 4, the slide ribs 22 are fit into the slide grooves 13, and thereby the tray frame 5 is mounted in the case body 4. The resilient member 6 is located in between the front wall 18*a* of the tray frame 5 and the front wall 4*b* of the case body 4. When the tray frame 5 is mounted in the case body 4 as such, the rear of the case body 4 is concealed by the upright wall 7*b* of the rear end wall 7, and the hinge protrusions 3 and the upright wall 7*b* of the rear end wall 7 are substantially on the same vertical plane with the recesses for receiving the hinge blocks 11 therebetween. Then, by coupling the hinge protrusion 3 and the hinge block 11 with the hinge pin 17, the lid 2 is rotatably attached to the case body 4. The assembly may be carried out in a way that first the lid 2 is attached to the case body 4.

In use of the vanity case 1, in order that the lid 2 turns and opens the case body 4, the upright wall 7*b* of the rear end wall 7 is pushed toward the front of the case body 4 with a finger or the like. The upright wall 7*b* together with the hinge protrusions 3 and the hinge blocks 11 forms a cohesive appearance. When pushing the rear end wall 7 forwards, the tray frame 5 slides toward the front of the case body 4 with opposing the resilient force of the resilient member 6. By the tray frame 5 being moved forwards, the engaging protrusion 28 of the tray frame 5 moves away from the hook piece 16 of the lid 2. At the same time, the lid 2, which is biased by the biasing member 9 toward opening, is turned up and the hook piece 16 rises above the engaging protrusion 28. Once the lid 2 is turned up, the hook 8 no longer gets in the engaging state, and the lid 2 can be opened smoothly. After the lid 2 is turned up, by moving the finger away from the rear end wall 7, the tray frame 5 is slid backwards in the case body 4 by the resilient member 6 elastically biasing.

On the other hand, in closing the lid 2, while the opened lid 2 is being closed, the hook piece 16 of the lid 2 goes through the through hole 27 of the tray frame 5 and gets under the canopy 18*d*. The hook piece 16, which is under the canopy 18*d*, contacts the engaging protrusion 28 of the tray frame 5 and pushes the tray frame 5 toward the front of the case body 4. By pushing the engaging protrusion 28, the tray frame 5 slides forwards with opposing the resilient force of the resilient member 6, and thus, the tab of the hook piece 16 gets under the engaging protrusion 28 so that the hook 8 is in an engaging state, and the case body 4 is kept closed by the lid 2.

In the vanity case 1 according to the present embodiment, the rear end wall 7 of the tray frame 5 to straddle the back wall 4*a* of the case body 4 is provided, and the back wall 4*a* is formed extending in the left-to-right direction continuously.

Hence, the decrease in the strength of the case body 4 can be prevented and thus the case body 4 becoming larger or its containing capacity decreasing can be prevented with preventing dust or the like from easily intruding into the case body 4.

Further, because the rear end wall 7, the hinge blocks 11, and the hinge protrusions 3 are substantially on the same vertical plane and adjacent to each other, the rear of the case body 4 has a cohesive form and thus an improved appearance.

Moreover, since the rigid wall portion 12 that is lower in height and thicker, which the rear end wall 7 straddles, is formed in the back wall 4*a*, the strength of the case body 4 is increased to an appropriate degree.

Yet further, since in push operation the rear end wall 7 which extends between the hinge blocks 11 covering a wide range is used, the lid 2 can be opened with good operability in pushing the tray frame 5 forwards regardless of how the vanity case 1 is held.

Still further, since the biasing member 9 to bias the lid 2 toward opening is provided in between the case body 4 and the lid 2, once the engagement of the hook 8 is released by pushing the rear end wall 7, the hook 8 no longer gets in the engaging state when the finger is moved off the rear end wall 7, and the lid 2 can be opened smoothly.

Also, since the recess 26 is made in the rear end wall 7 to receive the lip 25 of the lid 2, the inside of the case body 4 is prevented from being directly in communication with the outside, and the inside of the case body 4 is prevented from being seen from behind with also preventing dust from intruding into it.

What is claimed is:

1. A vanity case which comprises a case body having a cavity and a back wall defining said cavity, a lid that is coupled to the back section of the case body in an openable/closable manner, and a tray frame that is received in the cavity of the case body so as to be slidable forwards and backwards, said lid having an engaging hook piece formed extending downwards on the front of its underside; said tray frame having an engaging portion that can engage with said engaging hook piece; and being always biased elastically backwards, said engaging hook piece of said lid being engaged with said engaging portion of said tray frame when said lid is closed against said case body and thus said lid taking a closed position;

the engagement between said engaging portion of said tray frame and said engaging hook piece of said lid being released when said tray frame is moved forwards, thus opening said lid, wherein a rear end wall is integrally formed on the rear end of said tray frame in its middle so as to straddle said back wall of the case body to be movable forwards and backwards, and when said rear end wall of said tray frame is pushed toward the front, said tray frame is moved forwards, thereby releasing said engagement between said engaging portion of said tray frame and said engaging hook piece of said lid.

2. The vanity case according to claim 1, wherein said rear end wall of said tray frame is made of a horizontal wall extending backwards from the top of a back wall defining said tray frame and an upright wall extending downwards from the end of said horizontal wall so as to straddle said back wall of the case body.

3. The vanity case according to claim 2, wherein a pair of hinge protrusions are formed protruding backwards on left and right ends of the back wall of said case body; left and right hinge blocks protrude downwards from the rear end of the underside of said lid and are hinge-coupled to the pair of hinge protrusions; and in the state where said lid is closed against said case body, the rear faces of said hinge protrusions, the rear faces of said hinge blocks, and the rear end wall of said tray frame are substantially on the same vertical plane.

4. The vanity case according to claim 1 or 2, wherein part of said back wall of the case body is formed as a rigid wall portion on which said rear end wall of said tray frame straddles, said rigid wall portion being lower in height and thicker than the rest of said back wall.

* * * * *